United States Patent [19]

Neuhold et al.

[11] Patent Number: 4,738,040

[45] Date of Patent: Apr. 19, 1988

[54] SLIDE FRAME AND METHOD OF INSERTING A FILM TRANSPARENCY IN A SLIDE FRAME

[75] Inventors: Arnold Neuhold, Farchant; Claus Pohl, Eschenlohe, both of Fed. Rep. of Germany

[73] Assignee: Geimuplast Peter Mundt GmbH. & Co. Kg., Farchant, Fed. Rep. of Germany

[21] Appl. No.: 861,268

[22] Filed: May 9, 1986

[30] Foreign Application Priority Data

May 17, 1985 [DE] Fed. Rep. of Germany ..... 3517873

[51] Int. Cl.[4] ..... G09F 1/12

[52] U.S. Cl. ..... 40/152; 40/16; 40/159

[58] Field of Search ..... 40/16, 152, 159, 153

[56] References Cited

U.S. PATENT DOCUMENTS 3,470,642 10/1969 Mundt et al. ..... 40/152
3,470,643 10/1969 Koeppe et al. ..... 40/152
3,478,456 11/1969 Mundt et al. ..... 40/152

FOREIGN PATENT DOCUMENTS 231195 5/1963 Austria .
1214898 4/1966 Fed. Rep. of Germany .
1264098 3/1968 Fed. Rep. of Germany .
1294065 4/1969 Fed. Rep. of Germany .
2748676 5/1978 Fed. Rep. of Germany .

*Primary Examiner*—Gene Mancene
*Assistant Examiner*—Wenceslao J. Contreras
*Attorney, Agent, or Firm*—Fleit, Jacobson, Cohn & Price

[57] ABSTRACT

The slide frame is made of elastic plastic and has an entrance slit which is adapted to be expanded throughout the width of the transparency to be inserted. The frame is formed at its opposite end with an additional expansible slit, which is also adapted to be expanded throughout the width of the transparency to be inserted and to such an extent that the two frame portions defining said additional slit do not obstruct the complete insertion of the transparency into the frame, and the film bed is constricted by a clamping rib, which is formed at and extends along a picture gate defining edge which extends at right angles to the direction in which the transparency is inserted into the frame. The slide frame comprises two frame members having broadsides facing each other. Said frame members are joined to each other only along a part of the periphery of the frame and have unconnected corner portions at both ends of each of said expansible slits and are joined to each other at the periphery of the frame between their corner portions disposed at corresponding ends of said expansible slits.

8 Claims, 2 Drawing Sheets

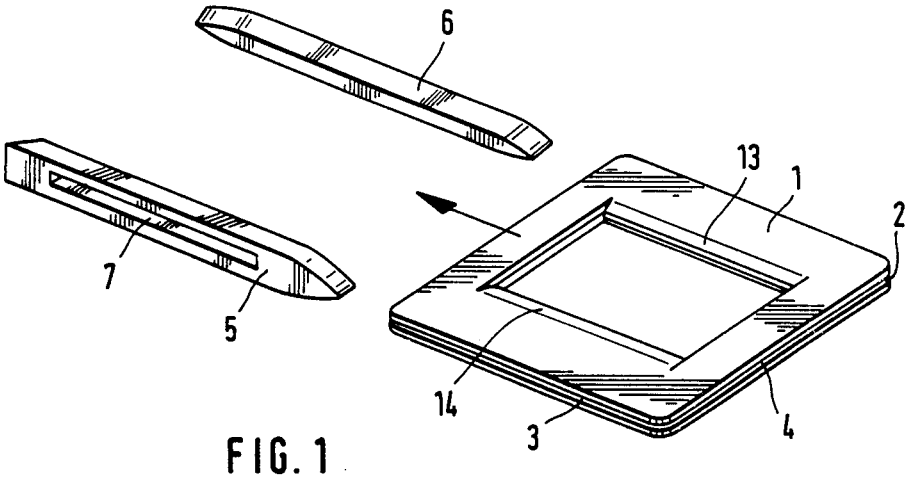
FIG. 1
FIG. 2
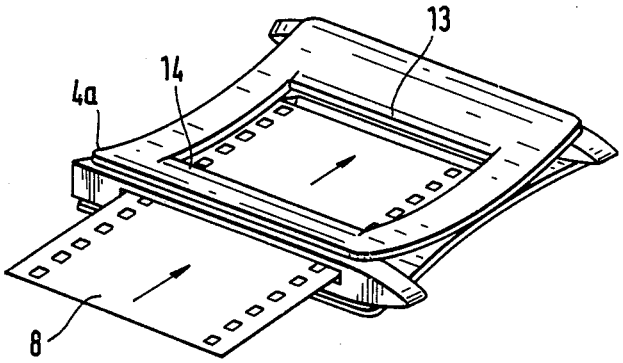

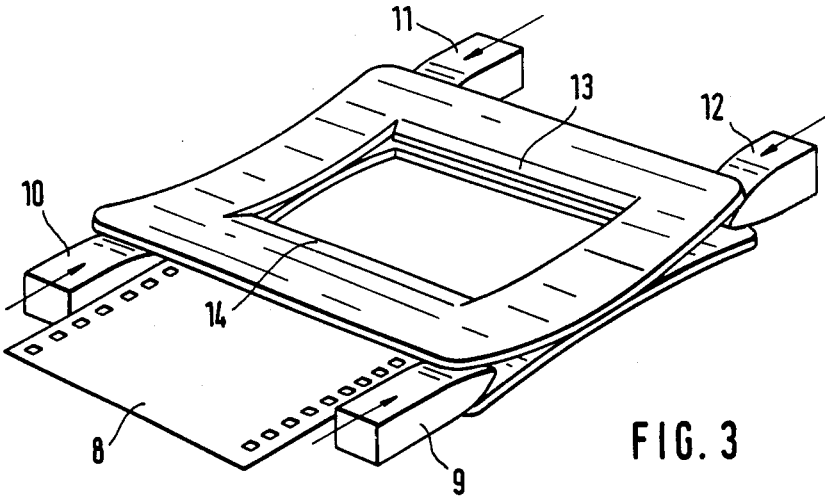
FIG. 3
FIG. 4
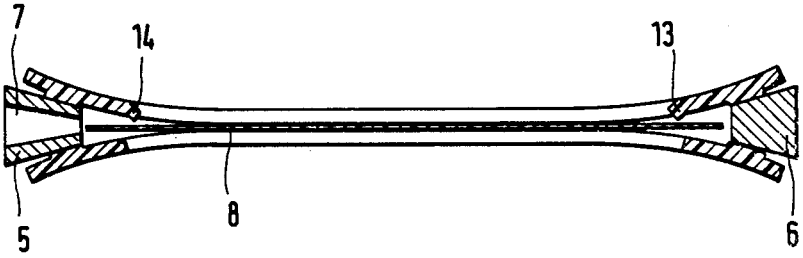
FIG. 5
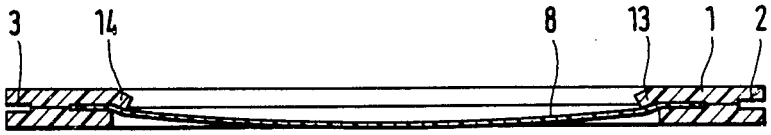

SLIDE FRAME AND METHOD OF INSERTING A FILM TRANSPARENCY IN A SLIDE FRAME

BACKGROUND OF THE INVENTION

1. Field of the Invention

This invention relates to a slide frame which is made of elastic plastic and has an entrance slit which is adapted to be expanded throughout the width of the transparency to be inserted.

2. Description of the Prior Art

Such slide frame is known from German Patent Publication No. 12 64 098, the applicant of which is the assignee of the present invention. In the use of the known slide frame, the film is inserted into the frame through the entrance slit. When the leading edge of the film has passed along the entire picture gate of the slide frame, it must be inserted into the slide frame also at that end thereof which is opposite to the entrance slit. This may give rise to difficulties if the film is cambered.

In most plastic slide frames the film-receiving pocket is closed at one end. This is apparent, e.g., from Austrian Patent Specification No. 231,195. It is known that a transparency is not perfectly planar, as a rule, because the film may be considerably cambered as a result of its development, particularly in film-suspending developing machines, or of a fast drying.

To ensure that the transparency in spite of its inevitable camber can be moved to a proper position for projection, i.e., into a film-receiving groove formed between the two frame members at the closed end of the film-receiving pocket, it is necessary to adopt various auxiliary measures, all of which involve disadvantages.

For instance, it is disclosed in Austrian Patent Specification No. 231,195 to bevel the side edges which define the above-mentioned film-receiving groove which is disposed opposite to the entrance slit. Said edges extend transversely to the direction in which the transparency is inserted. Owing to said beveled surfaces at said edges the transparency can easily slide from the entrance slit of the frame to the position for projection even if the transparency is not perfectly planar, and the groove will retain the film in the proper position.

The frames for use by amateurs usually have a thickness of 1.2 to 1.8 mm. In such frames the taper of the beveled surfaces at the edges of the picture gate is not sufficient for a safe insertion of a cambered film.

It is also known that the insertion of the transparency to the position for projection can be facilitated in that that edge of the frame which defines the rear edge of the picture gate is formed with a V-shaped recess. But such a recess can be provided in practice only in one half of the frame because the other half of the frame is required to define the projected picture. For this reason that feature can allow only for a camber in one direction. A film must usually be mounted in a frame with a predetermined orientation so that trouble due to cambered film can be avoided only in part by that known measure.

German Patent Specification No. 1,294,065 also deals with the difficulty that the film transparency may strike against the picture gate boundary at that end which is opposite to the entrance slit so that the transparency cannot be moved to its intended position. It is stated in German Patent Specification No. 1,294,065 that that disadvantage can be avoided in that each transparency is cut in the cutting station to have a concave edge at that end which will be the leading end as the transparency is inserted into a slide frame. But that measure requires an expensive cutting tool and will not be very effective because the concavity must be only small as the unexposed areas between the pictures on the film may be very narrow so that a strongly concave edge would be projected two.

From FIG. 15 of Published German Application No. 27 48 676 it is known to provide some clamping points near the rear end of the film-receiving pocket defined by the frame members so that the transparency will be frictionally retained at said clamping points against any desired displacement in the frame and will be held exactly in the desired position relative to the picture gate of the frame. Each of said clamping points is formed by a gently curved bulge, which is formed on one inside surface and protrudes into the film-receiving pocket, and a recess, which is formed in the opposite inside surface and registers with the bulge. By means of each bulge, the adjacent portion of the transparency will slightly be bent to enter the recess so that the transparency will be frictionally retained. That proposal has not proved satisfactory in practice because different films may differ in thickness. Besides, the constriction provided in the slotlike film track on the sides of the frame has rendered the insertion of the transparency more difficult because as the film is inserted it will strike against the bulges so that the film will be cambered and held back.

FIG. 8 of German Patent Specification No. 12 14 898 discloses a slide frame having two entrance slits, each of which opens directly, without a transition, into a film-receiving pocket. Said frame comprises two frame members which have broadsides facing each other. The frame members are joined to each other at their corner portions and are unconnected between their corner portions disposed at corresponding ends of the two slits. When the corresponding corner portions of the frame are forced toward each other, the two frame members will gape between the corresponding corner portions and the frame will then assume a somewhat tubular shape. For this reason such slide frames can be described as having a tubular filmreceiving pocket. The tubular film-receiving pocket opens at each end into a slit. To ensure that the transparency will be retained in the frame although the film-receiving pocket is tubular, the frame is provided with limiting cams and grooves at the top and bottom of the pocket. The limiting cams and grooves are provided for guiding the transparency at its side edges. Additional means for guiding the transparency being inserted consist of bores, which receive pins of a mounting machine so that said pins constitute guide stops for the transparency.

The slide frame known from German Patent No. 1,214,898 can be expanded at one end or at the other end of its tubular film-receiving pocket. Such a slide frame having a tubular film-receiving pocket can be expanded more effectively and more easily at the expansible slits than a frame which has a blind film-receiving pocket that is open only at one end. A special advantage afforded by the tubular pocket resides in that a transparency can be inserted into the frame from one end or the other. This will be significant if the frame is used on an automatic mounting machine because in such machine a slide frame of that kind will no longer have to be prearranged to have a predetermined orientation, as will be necessary if a transparency is to be automatically inserted on such machine into a slide frame having a blind film-receiving pocket.

SUMMARY OF THE INVENTION

It is an object of the invention to provide a slide frame which is of the kind described first herein-before and which permits even a cambered film transparency to be inserted reliably and in a simple manner whereas the slide frame ensures that the transparency will be more effectively clamped in position for projection.

In accordance with the invention that object is accomplished in that the frame is formed at its opposite end with an additional expansible slit, which is also adapted to be expanded throughout the width of the transparency to be inserted and to such an extent that the two frame portions defining said additional slit do not obstruct the complete insertion of the transparency into the frame, and the film bed is constructed by a clamping rib, which is formed at and extends along a picture gate defining edge which extends at right angles to the direction in which the transparency is inserted into the frame.

Because the frame is provided with an additional expansible slit at the end which is opposite to the entrance end and the two frame portions defining that additional slit do not obstruct the complete insertion of the transparency when said additional slit is expanded, even a cambered transparency can be inserted into the slide frame without a need for the auxiliary measures which were previously required. The transparency can be inserted as far as to its position for projection and this insertion can be effected by known mounting machines and regardless of whether the slide frame has been made by injection molding or by extruding and punching. Because the film bed is constricted by a clamping rib extending at and along a picture gate defining edge which is at right angles to the direction in which the transparency is inserted, the transparency will be more effectively clamped in position for projection. In the film bed which is constricted by the clamping rib provided in accordance with the invention, the transparency is cambered so that an adequate clamping action will be produced in cooperation with the clamping rib.

German Patent Specification No. 1,214,898 discussed hereinbefore fails to teach a person skilled in the art how the object set forth can be accomplished particularly also in connection with slide frames having a blind filmreceiving pocket. This has been proved by the actual technical development because otherwise the teaching of the later invention covered by German Patent No. 1,294,065 would not have been required.

An additional feature which can be embodied in the slide frame in accordance with the invention resides in that the film bed is constricted by two clamping ribs, which are provided on two mutually opposite picture gate defining edges of the frame which extend at right angles to the direction in which the transparency is inserted. That feature will result in an even stronger clamping action.

The slide frame in accordance with the invention may be expanded by means of wedges which are inserted into the slide frame at its corvers. A particularly advantageous expanding wedge of that kind, which is used to expand a slide frame embodying the invention, is provided with an opening, which constitutes a passage for the transparency as it is inserted. The transparency can be inserted into the slide frame in a particularly simple and reliably manner if the slide frame is expanded by a wedge formed with such opening.

BRIEF DESCRIPTION OF THE DRAWING

FIG. 1 shows a slide frame embodying the invention and expanding wedges used to carry out the method embodying the invention.

FIG. 2 is a diagrammatic view illustrating the method embodying the invention.

FIG. 3 illustrates a modification of the method embodying the invention.

FIGS. 4 and 5 are sectional views showing a slide frame embodying the invention.

FIG. 4 shows the transparency during the expanding and inserting step and

FIG. 5 shows the transparency in position for projection.

DETAILED DESCRIPTION OF THE PREFERRED EMBODIMENTS

Illustrative embodiments of the invention will now be explained more in detail with reference to the drawing. The slide frame 1 is made of elastic plastic and is formed at each of its opposite ends with an entrance slit, which is adapted to be elastically expanded. Adjacent to each entrance slit, those side portions of the frame which laterally define the path on which the transparency is inserted into the frame are so designed that the entrance slit can be expanded by the action of pairs of forces acting in mutually opposite directions on and at right angles to said specially designed side portions of the frame at predetermined points. For this purpose the entrance slits 2, 3 extend laterally through the side portions 4 and **4*a* of the frame, as is apparent from FIGS. 1 and 2 so that each entrance slit 2, 3 extends continuously throughout the width of the frame. As is shown in FIGS. 1 and 2, wedges 5 and 6 have been inserted into the continuous entrance slits 2 and 3 to extend through the side portions 4, 4*a* of the frame 1. The wedge 5 that is inserted into the entrance slit 2 is formed with an opening 7, which constitutes a passage for the transparency 8 being inserted. The direction in which the transpraency is inserted is indicated in FIG. 2** by two arrows.

The slide frame 1 comprises two frame members having broadsides facing each other and defining the expansible slits 2 and 3. Said frame members are unconnected at their corner portions and are joined to each other along a part of their periphery between the corner portions disposed at corresponding ends of the expansible slits 2, 3, which extend through said corner portions.

The film bed is constricted by two clamping ribs 13, 14, which are provided at the mutually opposite picture gate defining edges which extend at right angles to the direction in which the transparency is inserted. The ribs 13, 14 are exaggerated in the drawing.

It is apparent from FIG. 4 that the clamping ribs 13,14 provided on the picture gate defining edges which are at right angles to the direction in which the transparency is inserted cause the film bed to be constricted and the transparency to be cambered. In combination, said effects result in an adequate clamping of the transparency so that the latter is reliably held in the frame in position for projection.

Machines can be used to insert the transparency into the slide frame embodying the invention. This is preferably effected with the aid of wedges 5, 6 for expanding the mutually opposite entrance slits 2, 3, preferably at the same time, so that the slide frame will assume a condition in which the transparency can easily and satisfactorily be inserted into the frame to a position for projection. As soon as the transparency has reached its position for projection, the expanding wedges 5, 6 are withdrawn from the entrance slits 2, 3 so that the latter are no longer expanded. When the entrance slits 2, 3 are no longer expanded, the transparency will reliably be held in position for projection by means of the clamping ribs 13, 14 and owing to the resilience of the frame.

In the modified method illustrated in FIG. 3, wedges 9 to 12 are inserted into the entrance slits 2, 3 in the directions indicated by the arrows, i.e., in the direction in which the transparency is inserted and opposite thereto. In other respects the frame is expanded and the transparency is fixed in position for projection in the manner described hereinbefore.

It can be stated in conclusion that the slide frame embodying the invention will ensure that a transparency that has been inserted into the frame will be reliably clamped therein in position for projection in the frame because the film bed is constricted and because the transparency is clamped at opposite ends of the picture gate at the edges defining said gate. As a result, the film is forced to assume a certain camber. Nevertheless the film can easily and satisfactorily be inserted to its position for projection because the frame is preferably expanded at both ends at the same time.

An additional desirable result produced by the film-clamping means of the slide frame embodying the invention is an anti-pop action.

We claim:

1. A slide frame for holding a film transparency, which frame is made of elastic plastic and has an expansible entrance slit which is adapted to be expanded throughout the width of the transparency to be inserted, wherein the frame is formed at its opposite end with an additional expansible slit, which is also adapted to be expanded throughout the width of the transparency to be inserted and to such an extent that frame portions defining said additional slit do not obstruct the complete insertion of the transparency into the frame, and a film bed is constricted by a clamping rib, which is formed at and extends along a picture gate defining edge which extends at right angles to the direction in which the transparency is inserted into the frame.

2. A slide frame according to claim 1, wherein the film bed is constricted by two clamping ribs, which are provided at and extend along two mutually opposite edges which define the picture gate and extend at right angles to the direction in which the transparency is inserted into the frame.

3. A slide frame according to claim 1, wherein each of said expansible slits extends also through the side portions of the frame and is adapted to be expanded to form a gap which extends throughout the width of the frame.

4. A slide frame according to claim 3, which comprises two frame members having broadsides facing each other, wherein said frame members have unconnected corner portions at both ends of each of said expansible slits and are fixedly joined to each other at the periphery of the frame between their corner portions disposed at corresponding ends of said expansible slits.

5. A method of inserting a film transparency into a slide frame according to claim 1 through an expansible slit thereof, wherein said transparency is inserted through one of said slits to a position for projection while both said slits are expanded, and the frame is subsequently permitted to relax so that the elasticity of the plastic causes the slits to close and the transparency to be clamped by the clamping rib.

6. A method of inserting a film transparency into a slide frame according to claim 4, through an expansible slit thereof, wherein both of said slits are expanded by wedges inserted into said expansible slits to extend through said corner portions, said transparency is inserted through one of said slits to a position for projection while both said slits are expanded and the wedges are then removed from the frame to permit said frame to relax so that the elasticity of the plastic causes the slits to close and the transparency to be clamped by the clamping rib.

7. An expanding wedge for expanding an expansible slit of a slide frame according to claim 4, wherein the wedge is formed with an aperture, which constitutes a passage for the transparency.

8. An expanding wedge for expanding an expansible slit of a slide frame in a method according to claim 6, wherein the wedge is formed with an aperture, which constitutes a passage for the transparency.

* * * * *